United States Patent [19]

Larsen

[11] 4,046,326

[45] Sept. 6, 1977

[54] SHELL LINER ASSEMBLY

[75] Inventor: Darrell R. Larsen, Salt Lake City, Utah

[73] Assignee: Minneapolis Electric Steel Castings Company, Minneapolis, Minn.

[21] Appl. No.: 706,739

[22] Filed: July 19, 1976

Related U.S. Application Data

[63] Continuation-in-part of Ser. No. 629,503, Nov. 6, 1975, Pat. No. 4,018,393.

[51] Int. Cl.[2] ..... B02C 17/22

[52] U.S. Cl. ..... 241/182; 241/299

[58] Field of Search ..... 241/181–183, 241/284, 299

[56] References Cited

U.S. PATENT DOCUMENTS

| | | | |
|---|---|---|---|
| 1,128,901 | 2/1915 | Posselt | 241/183 |
| 1,534,000 | 4/1925 | Baker | 241/183 |
| 1,872,036 | 8/1932 | Hardinge | 241/182 X |
| 3,462,090 | 8/1969 | Landes et al. | 241/299 |
| 3,949,943 | 4/1976 | Schuler et al. | 241/183 |

*Primary Examiner*—Roy Lake
*Assistant Examiner*—Howard N. Goldberg
*Attorney, Agent, or Firm*—Merchant, Gould, Smith, Edell, Welter & Schmidt

[57] ABSTRACT

The disclosure is directed to a liner assembly for an autogenous ore grinding machine. The machine includes a large cylindrical drum which is rotated about a horizontal axis to comminute the ore. The liner assembly covers the inner cylindrical surface of the drum and consists of a plurality of longitudinal segments which are removably bolted to the drum. Each segment is made from a material which has good impact resistance and defines an irregular grinding surface to assist in the ore grinding process. An opening is formed through the segment body and extending longitudinally thereof, the opening being defined by walls that converge from the segment mounting surface to its grinding surface. A plurality of inserts, formed from material which is highly resistant to abrasion, are disposed in the opening and cooperate with the converging walls and each other in wedging relation for retainableengagement with the segment body bolted to the drum. The segments together define a grinding surface which assists in reducing the wear rate of the segment body, and thus the entire liner assembly.

24 Claims, 8 Drawing Figures

SHELL LINER ASSEMBLY

This is a continuation-in-part of my earlier copending application entitled "Improved Mounting for Grinder Liners," filed Nov. 6, 1975 under Ser. No. 629,503 now issued as U.S. Pat. No. 4,018,393.

The invention relates generally to apparatus for comminuting ore, and is specifically directed to an improved liner for an ore grinding mill used in commercial mining operations.

Grinding mills of this type may employ rods or balls to assist in the comminuting process as the mill is rotated, or the ore may be self-grinding in large autogenous mills. An example of the latter type mill consists of a large cylindrical drum mounted on bearings for rotation about a substantially horizontal axis and driven by a powerful motor through conventional reduction gearing. The axial ends of the drum are open, and the material to be comminuted is continuously fed into the mill at one end with the comminuted product continuously emerging from the other end.

From the economic standpoint, it is important to keep any type of ore grinding mill in operation as continuously as possible, keeping the downtime for maintenance or repair to a minimum. However, many ores (e.g., taconite) are extremely hard and highly abrasive, and in order to maintain continuous operation of the grinding mill it is necessary to provide a liner for the drum which is highly abrasion resistant, and also tough enough to withstand the continuous impact of the ore fragments.

Several difficulties arise in constructing abrasion-resistant liners for ore grinding mills. For example, since the access openings to the mill are usually limited in size, it follows that the liner must be made in a plurality of components. The enormous size of the ore grinding mill itself requires such multi-component construction, since a single piece liner would be virtually unmanageable. Other considerations, such as transportability and the technological limitation in successfully forming articles of any significant size from abrasion-resistant material, favor segmented liner construction.

It has been determined that the efficiency of ore grinding mills is improved when the exposed surface of the lining is not smooth, but rather is provided with ridges which extend axially. The lining is thus constructed of a plurality of bar segments which are axially aligned and secured to the cylindrical drum.

The aforementioned copending application is directed to an improved procedure and apparatus for securing abrasion-resistant liner segments to the cylindrical shell of an autogenous ore grinding mill. In the application, liner segments are formed with sockets of special shape and disposed at predetermined intervals, and are held within the cylindrical shell by bolts having heads received in the sockets, and threaded shanks passing through the liner segments and the mill shell to receive nuts at the outer surface. The sockets and heads are shaped to provide continuous flat contact areas of substantial size regardless of variations in center distances of holes axially along the shell.

This particular approach to securing the segmented liners to the shell represents a significant improvement due to previous difficulties in obtaining registration of bolt holes in the segments and shell, and continuous flush engagement of contiguous surfaces. It will also be appreciated that the improved system permits replacement of the liner segments upon removal of the mounting bolts and nuts. However, the structural configuration of the liner segments is necessarily complex, and does not lend itself to fabrication from materials which are highly abrasion resistant. Examples of ideal materials for this use are martensitic white iron or martensitic steel, both of which are extremely abrasion resistant. Materials such as these, however, undergo a significant volume change as they pass from the austenitic stage to martensitic form, and it is extremely difficult to form from such materials an article of significant size or complex configuration since the transformation to martensite (as the result of rapid cooling) may crack the article and render it useless in an ore crushing application. For this reason, the segmented liners are often made from a "tough" material which offers relatively good resistant to impact, although its resistance to abrasion is somewhat lower.

The subject invention is the result of an endeavor to employ material which is highly abrasion resistant in the formation of segmented liners for autogenous or grinding mills. The problem is a difficult one since the structural configuration of the liner segments is necessarily complex, and each segment is also bolted to the shell as discussed above. This type of mounting compounds the problem since the mounting is essentially at a plurality of specific points, and the extreme brittleness of highly abrasion resistant material can easily lead to a crack at a mounting point, and the segment breaks and falls away. I have found that the problem can be overcome by using a tough material for the primary structure of the liner segment, and coupling such usage with one or more inserts formed from highly abrasion-resistant material in a manner such that the insert or inserts represent primary exposure to the ore fragments but are always retained even if they break due to brittleness. This is accomplished through the formation of an opening extending entirely through the liner segment, and which has tapered sides converging towards the exposed surface. The insert or inserts are of conforming shape and size, having similar converging sides which engage and wedge against those of the segment opening. The inserts are placed into the segment opening from its back or unexposed side, projecting through to the exposed surface but being retained in this position by the wedging action. As the liner segment is bolted to the shell, the insert or inserts are positively and rigidly retained, capable of communicating the ore but incapable of escape. Accordingly, the hard, abrasion resistant material is surrounded and retained by the tough, impact resistant material.

A filler or backing formed from a resilient material (e.g., urethane or rubber) may be disposed between the back surface of the insert and the shell surface to reduce forces of impact on the inserts from acting directly on the shell surface.

In the preferred embodiment, a plurality of inserts are provided for each segment opening, the sides of the respective inserts being complementarily tapered in wedging relation, and together defining a continuous abrasion resistant surface capable of efficiently comminuting the ore while wearing much more slowly than previously used materials.

DESCRIPTION OF THE PREFERRED EMBODIMENT

Figure 1:
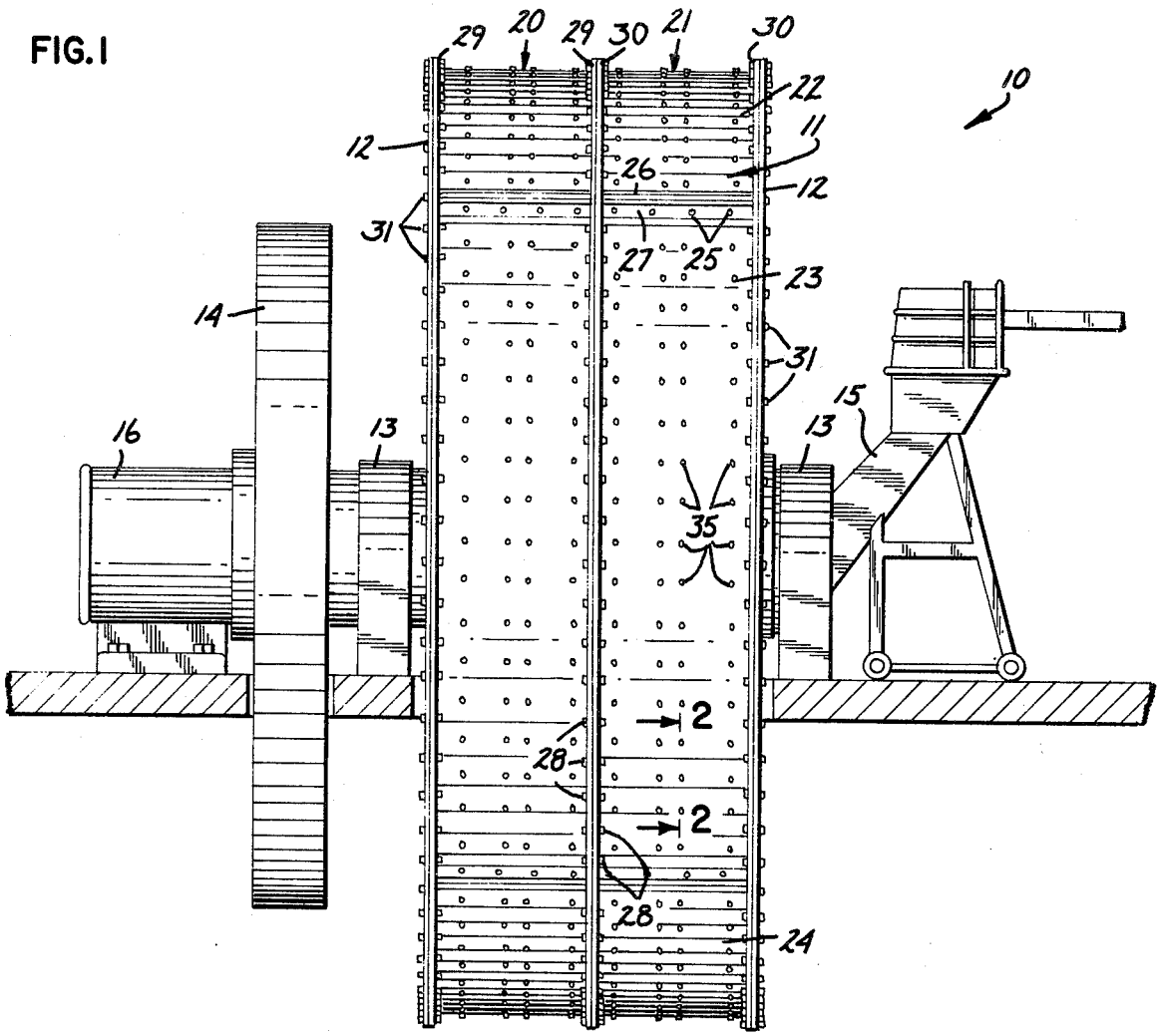
FIG. 1 is a somewhat schematic view in side elevation of an autogenous ore grinding mill in which the improved liner is used.

With initial reference to FIG. 1, an autogenous mill employing the inventive lining is referred to generally by the numeral 10. The mill 10 includes a hollow cylindrical drum or shell 11 closed by end walls 12 having large central axial openings (not shown) and arranged for rotation about a substantially horizontal axis in suitable bearings 13 by a drive of conventional nature in a suitable housing 14. Material to be comminuted is supplied to one of the axial openings in the end wall 12 through an appropriate chute 15, and the comminuted material is discharged through the opposite axial opening and from an outlet 16.

Cylindrical drum 11 is made up of a plurality of cylindrical sections 20, 21, each of which is in turn assembled from a set of cylindrical quadrants by bolts extending through axial flanges. For example, section 21 consists of quadrants 22–24 (one quadrant is not shown) which are secured together circumferentially by a plurality of bolts 25 passing through radially extending, axially aligned flanges 26, 27. The cylindrical sections 20, 21 are secured together axially by a plurality of bolts 28 passing through circumferential flanges 29, 30 extending radially from the periphery of each side. The drum 11 is completed by securing the end walls 12 to the circumferential flanges 29, 30 by bolts 31.

Figure 2:
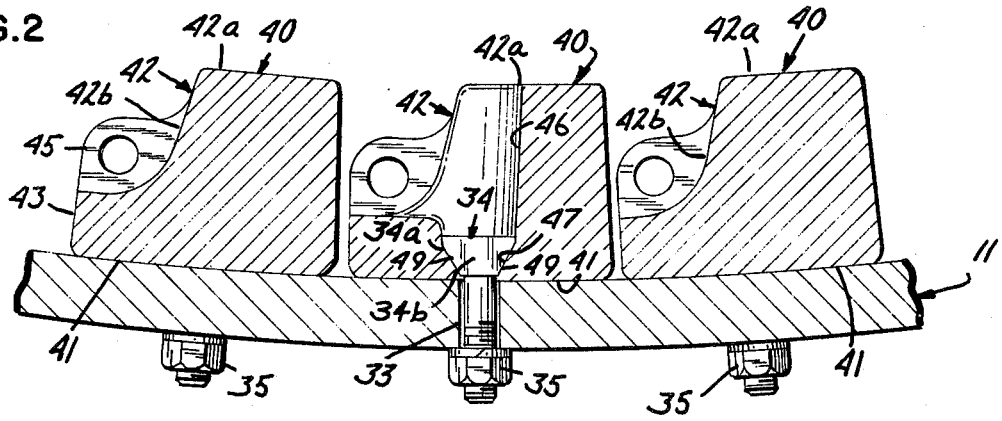
FIG. 2 is an enlarged fragmentary sectional view taken along the line 2—2 of FIG. 1 showing the segmented lining of the grinding mill.

With additional reference to FIG. 2, the cylindrical drum 11 is formed with a plurality of liner mounting holes 33 which receive liner mounting bolts 34 to secure, with nuts 35, a plurality of liner segments or components 40. The holes 33 are positioned in a pattern defining axial rows, the rows being spaced equiangularly about the drum, and in circumferential rows which are irregularly spaced axially of the drum. The bolt holes 33 are slightly larger in diameter than the bolts 34, exemplary dimensions being 2 inch holes bored for traversal by 1¾ inch bolts.

Figure 8:
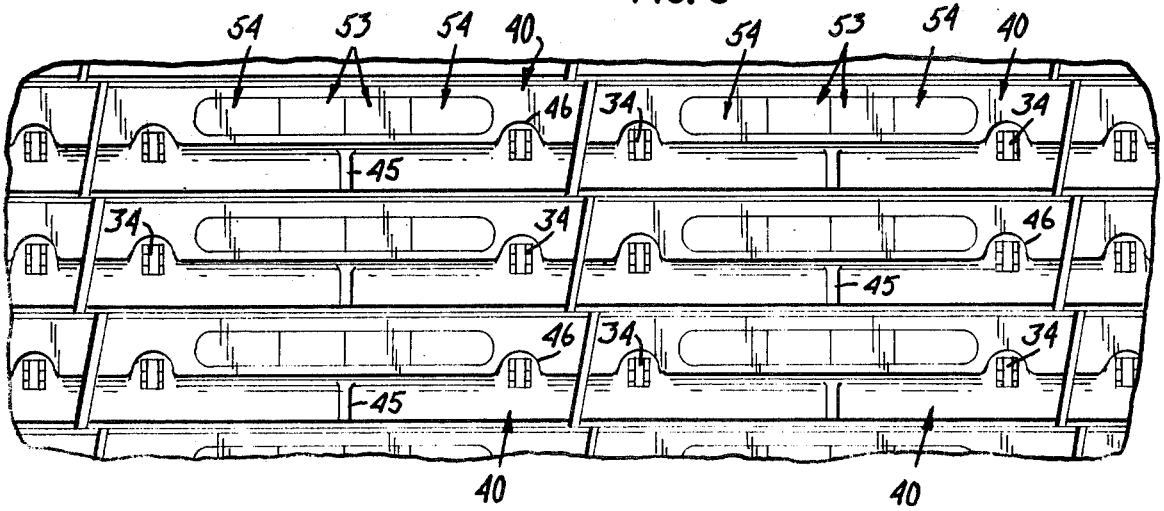
FIG. 8 is a fragmentary view showing the segmented lining of the grinding mill according to the invention and viewed radially outward from within the mill.

With reference to FIGS. 2 and 8, an inner circumferential lining for the drum 11 is formed from a plurality of the longitudinal liner segments 40 bolted to the drum 11 to virtually cover its inner cylindrical surface. As shown in FIG. 8, the segments 40 are arranged in longitudinal rows disposed in alignment with the drum rotational axis, and at the same time defining circumferential rows by reason of disposition of the mounting holes 33 and mounting bolts 34.

Each of the liner segments 40 has a mounting surface 41 which is slightly curved to conform to the inner radius of the drum 11, an inner grinding surface 42 of irregular contour, and surfaces 43 for apposition with adjacent liner segments 40. As shown in FIG. 8, the ends of each segment 40 are slightly oblique.

As shown in FIG. 2, each grinding surface 42 defines an elevated tumbling ridge 42*a* which represents the farthest region of the segment 40 from the inner surface of drum 11. The tumbling ridge 42*a* falls off to a lower convex surface 42*b* from which a centrally disposed lifting hook 45 projects.

With additional reference to FIG. 8, the overall configuration of the liner grinding surface is undulated, defined by alternating, axially extending ridges and valleys, which together increase the effectiveness of the tumbling and ore grinding process as the drum 11 rotates.

Figure 3:
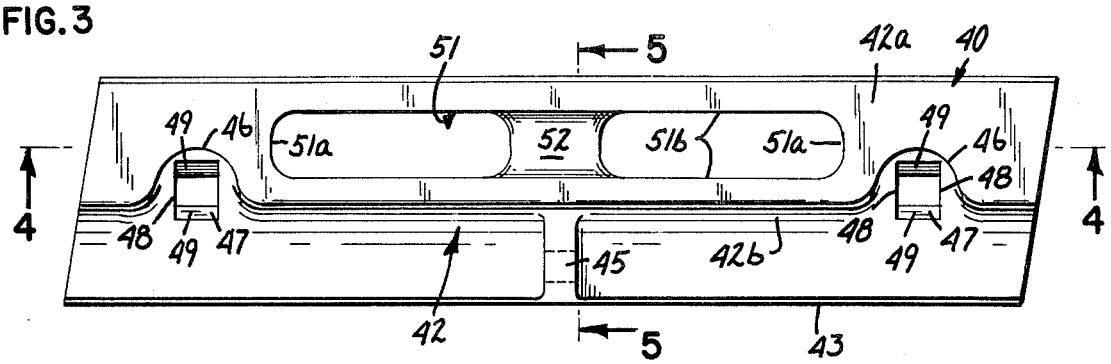
FIG. 3 is an enlarged view in top plan of one segment of the lining, the segment shown without abrasion resistant inserts.

As mentioned above, each of the liner segments 40 is bolted to the drum 11 through the use of mounting bolts 34 passing through mounting holes 33 and nuts 35. To accommodate the mounting bolts 34, each of the segments 40 is formed with a pair of arcuate recesses 46 which extend into that portion of the segment body defining the elevated tumbling ridge 42*a*. With additional reference to FIG. 3, each of the arcuate recesses 46 partially surrounds a bolt socket 47 which is generally angular in shape, defined by a pair of opposed straight walls 48 which are disposed generally perpendicular to the axis of the liner, and separated, in the direction of the axis of the liner, by a distance somewhat greater than the diameter of the bolt 34. The bolt socket has a second pair of opposed walls 49 which diverge from the socket bottom to define oblique planar surfaces (FIG. 2) and then extend for a short distance perpendicularly to the inner drum surface.

With continued reference to FIG. 2, the bolt 34 includes a threaded shank and a head which conforms generally to the bolt socket 47. Thus, the head of each bolt 34 has tapered sides 34*a* conforming to the oblique socket surfaces 49, and opposed, flat parallel surfaces 34*b*. However, the distance between the surfaces 34*b* is considerably less than the distance between the walls 48 of socket 47, thus affording a degree of relative lateral movement between the bolt 34 and the segment 40. This in turn enables the threaded shank of the bolt 34 to at all times extend perpendicularly through the drum 11 and hold the liner segments to the shell without undesired distortion stresses. At the same time, this structural configuration permits rapid mounting of the liner segments 40 to the drum 11 due to the leeway in socket 47—hole 33 alignment. Reference is made to the above-identified copending application for additional details of the structure and cooperative function of the bolts 34 and sockets 47.

Due to the irregularity and general complexity of the liner segments 40, technological limitations prevent them from being fabricated from material which is highly resistant to abrasion. The problem arises from the difficulty in successfully heat treating articles of significant size and complexity without severe dimensional changes and stress cracking. Accordingly, a compromise is usually made by using a material which is less brittle and less resistant to abrasion, but having good resistance to impact. However, because of the lesser resistance to abrasion, the liner segments have a tendency to wear somewhat more quickly than desired, resulting in frequent replacement and downtime, particularly where the ore grinding operation is continuous.

The wear problem is overcome to a substantial degree through the use of a plurality of inserts in each of the liner segments. The inserts are of simple structural configuration, thus enabling their formation from material which is highly resistant to abrasion. The liner segments are made from tough, impact resistant material which is difficult to break and therefore capable of retaining the segments throughout their wear life. The inserts are disposed within the liner segments in regions where the highest rate of wear normally occurs and are held in place by mechanical wedging, so that even if one cracks or breaks it is retained within the liner segment and capable of continuing its function.

Several materials are capable of use for both the liners and segments. However, I prefer to use martensitic steel for both, which can be heat treated to be either tough and impact resistant, or highly resistant to abrasion. The procedures for obtaining these performance characteristics are well known in the metallurgical art. Another suitable example of an abrasion resistant material for the inserts is martensitic white iron. Manganese steel may also be used as a tough material from which the liner segments may be formed.

With reference to FIGS. 3–8, each of the liner segments 40 further comprises an elongated opening 51 which, with the exception of a thick central web 52, extends entirely through the segment 40 in the radial dirction; i.e., from the grinding surface 42 to the mounting surface 41. As particularly shown in FIG. 3, each of the elongated openings 51 is disposed wholly within the body of the segment 40; i.e., the segment body 40 entirely surrounds the opening 51. As viewed in the top plan of FIG. 3, the corners of the elongated opening 51 are rounded to better resist failure due to stress. As viewed in FIGS. 4 and 5, the elongated opening 51 has nonparallel end walls **51*a* and nonparallel longitudinal side walls 51*b*, the walls 51*a*, 51*b* converging from the mounting surface 41 to the grinding surface 42**.

Figure 4:
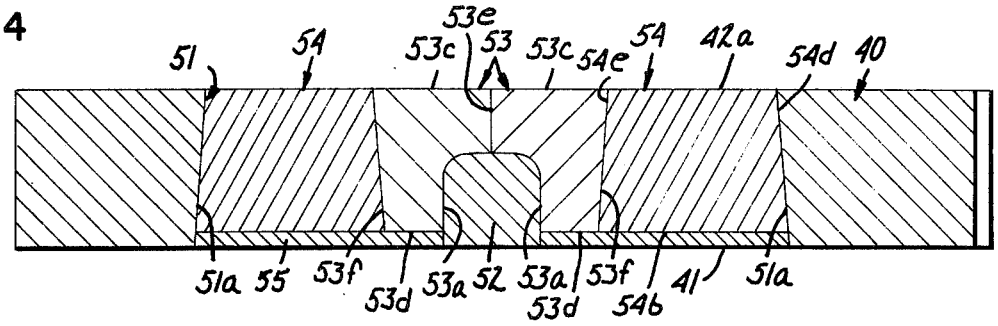
FIG. 4 is a view in longitudinal section of the line or segment taken along the line 4—4 of FIG. 3, the segment shown with abrasion resistant inserts in place.
Figure 5:
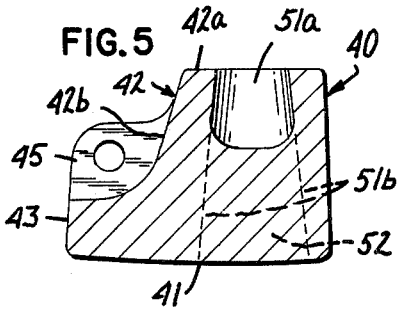
FIG. 5 is a transverse sectional view of the liner segment taken along the line 5—5 of FIG. 3.
Figure 6:
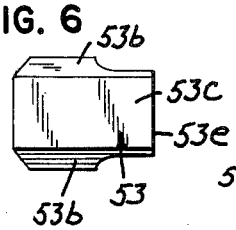
FIG. 6 is a view in top plan of one of the abrasion resistant inserts for the liner segment.
Figure 7:
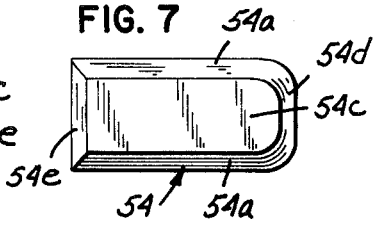
FIG. 7 is a view in top plan of another abrasion resistant insert for the liner segment.

Each of the elongated openings 51 is provided with two pairs of inserts 53, 54, which are specifically shown in FIGS. 4, 6 and 7. Insert 53 comprises a simple block having an arcuate undersurface **53*a* conforming to the shape of the web 52, the thickness of which is approximately ½ of the depth of the elongated opening 51. Insert 53 has opposed converging side walls 53*b* which conform in shape to the side walls 51*b* of the opening 51. Insert 53 also defines a grinding surface 53*c*, a bottom or mounting surface 53*d* and an end wall 53*e* which is commonly perpendicular to the surfaces 53*c*, 53*d*. The opposite end wall 53*f* is oblique to the surfaces 53*c*, 53*d*; and with two of the inserts 53 mated together as shown in FIG. 4, the two end walls 53*f*** diverge from the bottom to the top.

Insert 54 is of slightly greater longitudinal dimension than the insert 53, and includes side walls **54*a* which converge from a bottom or mounting surface 54*b* to a flat grinding surface 54*c* for conforming engagement with the side walls 51*b* of opening 51. Insert 54 also includes an end wall 54*d* which is rounded in conformance to the end wall 51*a* of opening 51, and an end wall 54*e* which is squared to conform to the end wall 53*f* of insert 53. As shown in FIG. 4, the end walls 54*d*, 54*e* converge from the bottom 54*b* to the grinding surface 54*c***.

As described, it will be appreciated that the inserts 53 and 54 must be placed in the elongated opening 51 from the bottom of the segment 40 (i.e., the mounting surface 41), and that they are retained in position due to the wedging relationship between side walls **51*b* of opening 51 with side walls 53*b*, 54*a* of the inserts. As viewed in FIG. 4, it will also be observed that a wedging relationship exists between the end walls 51*a*, 54*d* and 54*e*, 53*f*. The inserts 53, 54 are held in place prior to the time that the liner segment 40 is bolted to the drum 11 by a filler 55. As shown in FIG. 4, the radial distance or height of the inserts 53, 54 is slightly less than the corresponding dimension of the segment 40, and the filler 55 fills the remaining gap. The filler 55 is formed from a resilient material such as urethane or rubber; and although its presence is not essential, it is capable of presenting a better mounting surface to the drum 11, and also acts as a buffer to preclude the extremely hard inserts 53, 54** from acting directly on the drum surface in response to forces of impact.

It is also of importance that the several grinding surfaces **53*c*, 54*c* together fill the openings 51 completely, thereby defining a continuous surface which greatly reduces the eroding effect of the ore. This is accomplished through the use of wedging as well as the thick web 52**, which provides intermediate support without interrupting the grinding surface.

Although the preferred embodiment discloses the inventive concept in terms of a plurality of inserts having a greater abrasion resistance than the associated liner segment, with the primary objective of extending the wear life of the segment, the concept is equally applicable to the use of other materials having different properties to satisfy different needs.

What is claimed is:

1. A removeable liner assembly for the shell of an ore grinding machine, the assembly including a plurality of liner segments each of which comprises:

a. a segment body of predetermined size and configuration, the segment body being formed from a first material and defining a mounting surface and a grinding surface;

b. means for connecting the segment body to the shell of the ore grinding machine;

c. an opening formed entirely through the segment body and disposed wholly within the segment body, the opening defined by a wall surface that converges from the mounting surface to the grinding surface;

d. and insert means formed from a second material and conforming generally to the shape and size of the opening, the insert means being disposed in the opening in wedging relation for retaining engagement thereby.

2. The liner assembly defined by claim 1, wherein the segment body is longitudinal and the opening extends longitudinally of the body.

3. The liner assembly defined by claim 2, wherein the grinding surface is irregular in shape, defining an elevated ridge which extends longitudinally of the body, said opening being disposed within the elevated ridge.

4. The liner assembly defined by claim 1, wherein the opening comprises at least one pair of opposed converging side walls.

5. The opening defined by claim 1, wherein the opening comprises two pairs of opposed, converging side walls.

6. The liner assembly defined by claim 1, wherein the insert means comprises a plurality of separate insert members each of which is constructed to cooperate in wedging relation to at least one other insert member and the wall surface of the opening.

7. The liner assembly defined by claim 6, wherein at least one insert member of a first configuration is formed with a first pair of converging side walls conforming to the wall surface at the opening, and a second pair of converging side walls; and at least one insert member of a second configuration is formed with a first pair of converging side walls conforming to the wall surface at the opening, and a second pair of side walls at least one of which mateably engages one of the second pair of side walls of the first insert member.

8. The liner assembly defined by claim 7, wherein:

a. the segment body is longitudinal;

b. the opening extends longitudinally of the body;

c. and the insert means comprises a pair of insert members of said first configuration, and a pair of insert members of said second configuration, said insert members being longitudinally aligned within said opening.

9. The liner assembly defined by claim 8, and further comprising a web extending across the longitudinal opening and recessed from the grinding surface of the segment body; and each of the insert members of second configuration is constructed to engage the web in conforming relation.

10. The liner assembly defined by claim 6, wherein each of said insert members defines a grinding surface, said grinding surfaces together defining a continuous surface relative to the opening.

11. The liner assembly defined by claim 1, and further comprising a strengthening web extending across the opening and recessed from the grinding surface of the segment body, the insert means being constructed to engage the strengthening web in conforming relation.

12. The liner assembly defined by claim 1, wherein the insert means are formed from material which has a greater resistance to abrasion than the material of the segment body.

13. The liner assembly defined by claim 12, wherein the segment body is made from material which has a greater resistance to impact than the material of the insert member.

14. The liner assembly defined by claim 13, wherein the segment body and insert means are formed from martensitic steel tempered to the said characteristics.

15. The liner assembly defined by claim 1, wherein the insert means are recessed from the mounting surface of the segment body.

16. The liner assembly defined by claim 15, wherein filler material fills the recessed area defined by the insert means and mounting surface.

17. The liner assembly defined by claim 16, wherein the filler material comprises a resilient polymer.

18. The liner assembly defined by claim 1, wherein each segment body is elongated in shape, defined by a pair of generally parallel longitudinal side walls and a pair of generally parallel end walls that are oblique to the side walls.

19. The liner assembly defined by claim 1, wherein each segment body further comprises a lifting hook projecting from the grinding surface of the segment body for mounting purposes.

20. The liner assembly defined by claim 1, wherein said segment bodies are connected to the shell independently of each other.

21. The liner assembly defined by claim 1, wherein the segment bodies are spaced from each other within the liner assembly.

22. The liner assembly defined by claim 1, wherein the connecting means comprises two nut and bolt assemblies for each segment body, each nut and bolt assembly bolting the associated segment body directly to the shell.

23. A removeable liner assembly for the shell of an ore grinding machine, the assembly including a plurality of liner segments each of which comprises:

a. a longitudinal segment body formed from a first material and defining a mounting surface and a grinding surface, the grinding surface being irregular in shape and defining an elevated ridge which extends longitudinally of the body;

b. means for connecting the segment body to the shell of the ore grinding machine;

c. an opening formed entirely through the segment body and extending longitudinally within the elevated ridge, the opening defined by a wall surface that converges from the mounting surface to the grinding surface;

d. and insert means formed from a second material and conforming generally to the shape and size of the opening, the insert means being disposed in the opening in wedging relation for retaining engagement thereby.

24. A removeable liner assembly for the shell of an ore grinding machine, the assembly including a plurality of liner segments each of which comprises:

a. a segment body of predetermined size and configuration, the segment body being formed from a first material and defining a mounting surface and a grinding surface;

b. means for connecting the segment body to the shell of the ore grinding machine;

c. an opening formed entirely through the segment body and defined by a wall surface that converges from the mounting surface to the grinding surface;

d. and insert means formed from a second material and conforming generally to the shape and size of the opening, the insert means comprising a plurality of separate insert members each of which is constructed to cooperate in wedging relation with at least one other insert member and the wall surface of the opening for retaining engagement thereby.

* * * * *